US008536807B2

(12) United States Patent
Lin et al.

(10) Patent No.: US 8,536,807 B2
(45) Date of Patent: Sep. 17, 2013

(54) LED BULB

(75) Inventors: Shikai Lin, Guangdong (CN); Haipeng Xiang, Dongguan (CN)

(73) Assignee: Dongguan Hexi Optical Electric Technology Co., Ltd. (CN)

( * ) Notice: Subject to any disclaimer, the term of this patent is extended or adjusted under 35 U.S.C. 154(b) by 792 days.

(21) Appl. No.: 12/651,974

(22) Filed: Jan. 4, 2010

(65) Prior Publication Data

US 2011/0163675 A1 Jul. 7, 2011

(51) Int. Cl.
*H01J 11/00* (2012.01)

(52) U.S. Cl.
USPC ..... 315/358; 315/32; 315/73

(58) Field of Classification Search
USPC ..... 315/32, 73, 112, 113, 118, 185 R, 315/192, 200 R, 205, 312, 358
See application file for complete search history.

(56) References Cited

U.S. PATENT DOCUMENTS

| | | | | |
|---|---|---|---|---|
| 7,726,836 | B2 * | 6/2010 | Chen | 362/249.02 |
| 8,167,677 | B2 * | 5/2012 | Huang | 445/44 |
| 2003/0031015 | A1 * | 2/2003 | Ishibashi | 362/249 |
| 2006/0193130 | A1 * | 8/2006 | Ishibashi | 362/227 |

* cited by examiner

*Primary Examiner* — Douglas W Owens
*Assistant Examiner* — Jianzi Chen
(74) *Attorney, Agent, or Firm* — Polster, Lieder, Woodruff & Lucchesi, LC

(57) ABSTRACT

The invention relates to the technical field of illumination lamps, in particular to an LED bulb. The invention comprises a lamp cap, a lampshade, LEDS and a circuit board, wherein the bottom end of the lampshade is mounted and fixed at the top end of the lamp cap; the circuit board is mounted and fixed in the lampshade and also electrically connected with the lamp cap; and the lampshade is filled with a mixed gas which transfers heat produced by the LEDS outside the bulb. The invention transfers heat produced by the LEDS by a mixed gas; the LED bulb has such advantages to as small weight, small volume and low production cost; besides, by using the mixed gas as heat transfer medium, the invention can radiate heat produced by the LEDS outside the bulb rapidly so as to effectively solve the heat radiation issue of the LEDS and prolong the service life of the LEDS.

11 Claims, 3 Drawing Sheets

LED BULB

FIELD OF THE INVENTION

The invention relates to the technical field of illumination lamps, in particular to an LED bulb.

BACKGROUND OF THE INVENTION

In recent years, LED (light emitting diode) has been widely used in daily life due to its long service life, low energy consumption and obviously to saved energy. For example, some manufacturers have designed LED bulbs which can be directly mounted in common bulb sockets to replace such existing bulbs as tungsten lamps.

At present, an LED bulb available in the market comprises a lamp cap, a lampshade, an aluminum substrate and LEDS mounted and fixed on the aluminum substrate. The bottom end of the aluminum substrate is fixed with an aluminum alloy cooling device; the lamp cap is fixed at the bottom end of the aluminum alloy cooling device and the lamp cap is also electrically connected with the LEDS; and the lampshade is mounted and fixed at the top end of the aluminum substrate and used for shading the LEDS. When the LEDS illuminate, rays from the LEDS can be shone out through the lampshade so as to achieve the proposal of illumination. However, when the LED bulb works, as the LEDS can produce a large volume of heat, only when heat produced by the LEDS is radiated in time by the aluminum alloy cooling device located at the bottom end of the aluminum substrate, the normal working of the LEDS can be kept, or else, the service life of the LEDS may be shortened, even the LEDS may be damaged. Therefore, in the existing bulbs, LEDS are mounted and fixed on the aluminum substrate generally and an aluminum alloy cooling device is provided. However, as aluminum substrates and aluminum alloy cooling devices have relatively large weights and occupy certain volumes of the LED bulb, the existing LED bulbs have large weight, large volume and high production cost.

Besides, as LEDS in the LED bulb radiate rays in one direction intensively, uneven illumination is caused and dark areas are formed at the two sides of the LED bulb, those are problems of LED bulbs unable to be solved in the prior art.

SUMMARY OF THE INVENTION

On account of the defects in the prior art, the invention provides an LED bulb with small weight, small volume, low production cost, rapid heat radiation and even illumination.

In order to achieve the purpose, the invention adopts the following technical proposal:

An LED bulb is provided, comprising: a lamp cap, a lampshade, LEDS and a circuit board, wherein the bottom end of the lampshade is mounted and fixed at the top end of the lamp cap; the circuit board is mounted and fixed in the lampshade and also electrically connected with the lamp cap; and the lampshade is filled with a mixed gas which transfers heat produced by the LEDS outside the bulb.

The mixed gas is a mixed gas composed of nitrogen and argon, wherein the portion of nitrogen is 30%-90% of the total volume of the mixed gas and the portion of argon is 10%-70% of the total volume of the mixed gas.

The mixed gas is one of nitrogen, argon, neon, krypton and xenon. The mixed gas is a mixed gas composed of nitrogen, argon, krypton and xenon.

The portions of nitrogen, argon, krypton and xenon in the total volume of the mixed gas are respectively as follows: the portion of nitrogen is 60% of the total volume of the mixed gas, the portion of argon is 25% of the total volume of the mixed gas, the portion of krypton is 15% of the total volume of the mixed gas, and, the portion of xenon is 5% of the total volume of the mixed gas.

The LED is an SMD LED.

The circuit board consists of two crisscrossed printed circuit boards, and LEDS are respectively welded and fixed at the front sides and the back sides of the printed circuit boards.

The circuit board is provided with a rectification module, the input end of the rectification module is connected with the AC input end of the lamp cap, and the LEDS are connected between the positive output end and the negative output end of the rectification module in series.

The invention has the advantages that the invention comprises a lamp cap, a lampshade, LEDS and a circuit board, wherein the bottom end of the lampshade is mounted and fixed at the top end of the lamp cap, the circuit board is mounted and fixed in the lampshade and also electrically connected with the lamp cap, and the lampshade is filled with a mixed gas which transfers heat produced by the LEDS outside the bulb; the invention transfers heat produced by the LED outside by a mixed gas; the LED bulb has such advantages as small weight, small volume and low production cost; besides, by using the mixed gas as heat transfer medium, the invention can radiate heat produced by the LEDS outside the bulb rapidly so as to effectively solve the heat radiation issue of the LEDS and prolong the service life of the LEDS.

Besides, in the invention, the LEDS are arranged on the circuit board consisting of crisscrossed printed circuit boards and the LEDS are arranged in all directions to guarantee more even illumination when the LED bulb illuminates.

BRIEF DESCRIPTION OF THE DRAWINGS

The following gives further illustration to this practical Invention together with the attached pictures.

DETAILED DESCRIPTION OF THE INVENTION

Figure 1:
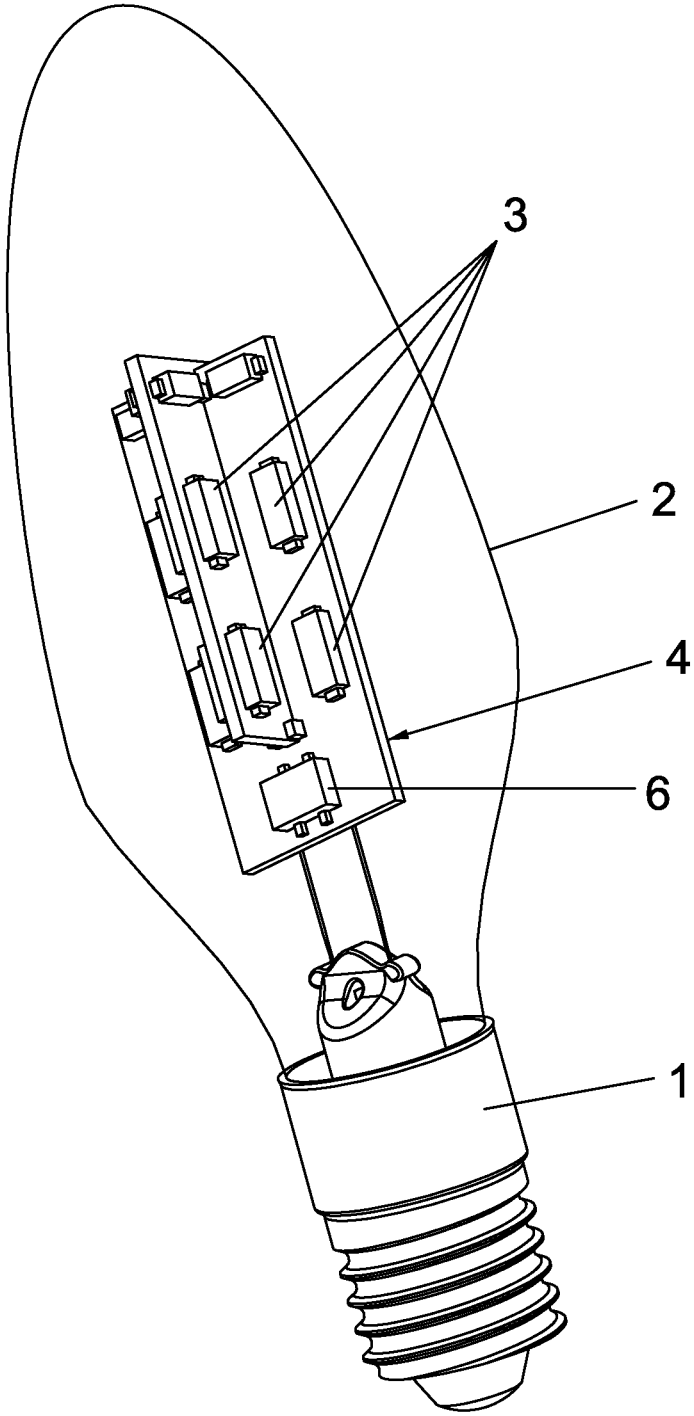
FIG. 1 refers to the structural diagram of the invention.
Figure 2:
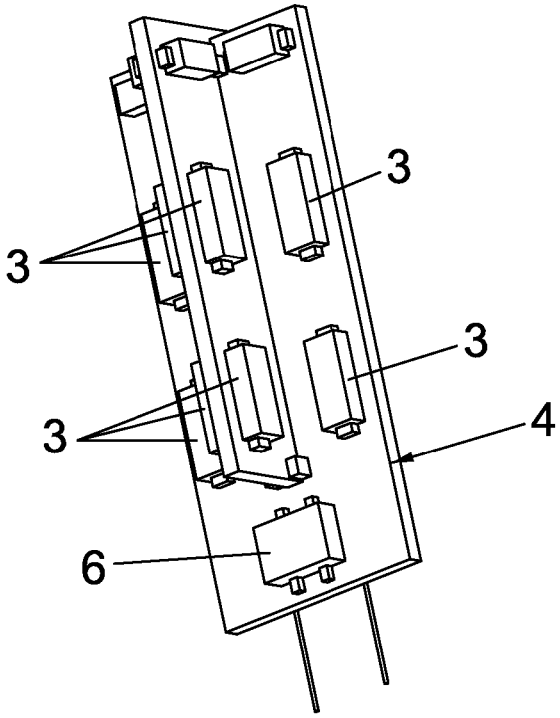
FIG. 2 refers to the structural diagram of the circuit board in the invention.
Figure 3:
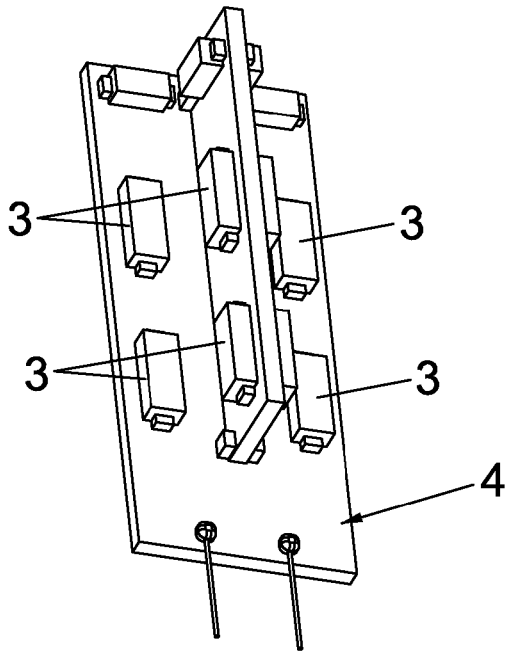
FIG. 3 refers to the structural diagram of the circuit board in the invention in another visual angle; and, FIG. 4 refers to the decomposition diagram of the circuit board in the invention.
Figure 4:
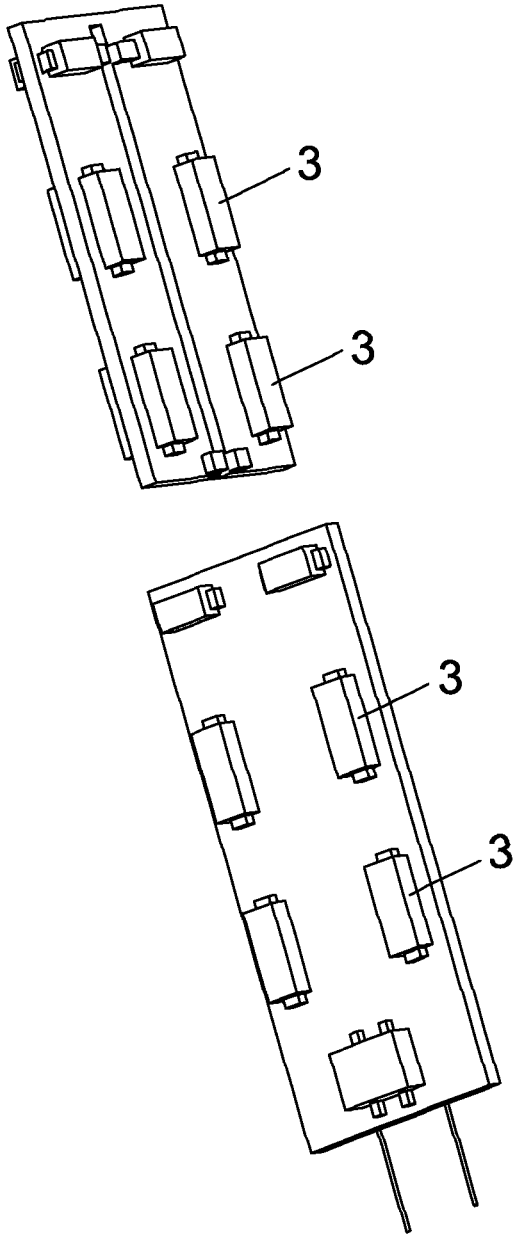

The invention is further described by combing the attached drawings (please refer to FIGS. 1 to 4). The LED bulb comprises a lamp cap 1, a lampshade 2, LEDS 3 and a circuit board 4, wherein the bottom end of the lampshade 2 is mounted and fixed at the top end of the lamp cap 1 such that the opening of the lampshade 2 can be enclosed by the lamp cap 1, the circuit board 4 is mounted and fixed in the lampshade 2 and also electrically connected with the lamp cap 1.

The lampshade 2 is filled with a mixed gas which transfers heat.

Further, the mixed gas is a mixed gas composed of nitrogen and argon, wherein the portion of nitrogen is 30%-90% of the total volume of the mixed gas and the portion of argon is 10%-70% of the total volume of the mixed gas.

In the invention, as the lampshade is filled with a mixed gas, when the LEDS illuminate, the LEDS can produce a large volume of heat, the mixed gas in the lampshade rises and flows when heated so as to transfer heat produced by the LEDS to the inner surface of the lampshade and then radiate heat by the lampshade. More specifically, the mixed gas in the embodiment is a mixed gas composed of nitrogen and argon. In one superior to implementation way, the components of the nitrogen-argon mixed gas include 30% of nitrogen and 70% of argon, nitrogen can transfer heat rapidly, while the most important function of argon is to increase the luminosities of the LED lamps besides heat transfer, argon makes LED lamps have greater luminosities and makes rays from the LEDS soft not dazzling. The nitrogen-argon mixed gas in the embodiment can transfer heat produced by the LEDS 3 to the lampshade 2 rapidly and then radiate heat by the lampshade 2. Of course, the nitrogen-argon mixed gas may have other mixed components, as long as the mixed components have heat transfer effect.

Of course, the mixed gas is one of nitrogen, argon, neon, krypton and xenon.

Or, the mixed gas is a mixed gas composed of nitrogen, argon, krypton and xenon. In one superior implementation way, portions of nitrogen, argon, krypton and xenon in the total volume of the mixed gas are respectively as follows: the portion of nitrogen is 60% of the total volume of the mixed gas, the portion of argon is 25% of the total volume of the mixed gas, the portion of krypton is 15% of the total volume of the mixed gas, and the portion of xenon is 5% of the total volume of the mixed gas.

All the above implementation ways can achieve the purpose of the invention and reach the expected effects of the invention. Specifically, the circuit board 4 consists of two crisscrossed printed circuit boards, and LEDS 3 are respectively welded and fixed at the front sides and the back sides of the printed circuit boards; as the LEDS 3 are arranged on the circuit board consisting of crisscrossed printed circuit boards and the LEDS are arranged in all directions such that rays from the LEDS are distributed in all directions, more even illumination is guaranteed when the LED bulb illuminates so as to solve the problems of uneven illumination and existence of dark areas when the LED bulb illuminates.

In the embodiment, the circuit board 4 consists of two printed circuit boards crisscrossed like a cross and the circuit board 4 has more planes in different directions to mount the LEDS 3. Of course, the circuit board 4 also may consist of three or four crisscrossed printed circuit boards and the circuit board 4 has more planes in different directions to mount the LEDS 3.

The LEDS 3 in the embodiment are SMD LEDS, preferably. As SMD LEDS have small volumes and produce less heat when in use, the weight and volume of the LED bulb can be further decreased. Of course, the LEDS 3 may be LEDS in other forms, not limited to the SMD LEDS adopted in the embodiment.

The circuit board 4 is provided with a rectification module 6, the input end of the rectification module 6 is connected with the AC input end of the lamp cap 1, and the LEDS are connected between the positive output end and the negative output end of the rectification module 6 in series.

The lampshade 2 in the embodiment is a transparent airtight glass shade from which rays from the LEDS 3 can be shone out so as to achieve the purpose of illumination. Of course, in order to achieve different illumination effects, the lampshade 2 also may be a lampshade 2 in other colors, such as white. Besides, it should be noted that the shape of the lampshade 2 is of a tip-top shape, a spherical shape, an elliptical shape or other shapes, not limited to the tip-top shape adopted in the embodiment.

The circuit board 4 is provided with a rectification module 6, the input end of the rectification module 6 is connected with the AC input end of the lamp cap 1, and the LEDS are connected between the positive output end and the negative output end of the rectification module 6 in series. More specifically, plural LEDS 3 are connected in series in a same direction to form a lamp string, wherein the anode end of the lamp string is connected with the anode of the rectification module 6 and the cathode end of the lamp string is connected with the cathode of the rectification module 6. The working principle of the structure is as follows: the rectification module 6 rectifies AC input from the lamp cap 1 into DC so as to supply power to the plural LEDS 3.

When used, the invention can replace such existing bulbs as tungsten lamps. The lamp cap 1 can be directly plugged in an existing common bulb socket and supplied with power by AC. When the LEDS 3 illuminate, the to mixed gas in the lampshade 2 rises and flows when heated so as to transfer heat produced by the LEDS 3 to the inner surface of the lampshade 2 and then to radiate heat by the lampshade 2. Compared with the existing LED bulbs, the invention can radiate heat produced by the LEDS 3 without installation of any heavy aluminum substrate or aluminum alloy cooling device; besides, the assembling and production process is simple, therefore, the invention has such advantages as small weight, small volume and low production cost.

The above contents relate to the superior embodiment of the invention. It shall be understood by the technicians in the industry that the invention is not limited to the contents of the description. On condition that the ideas of the invention are followed, the invention shall see further varied changes both in the special implementation way and the application scope.

What is claimed is:

1. An LED bulb comprising: a lamp cap (1), a lampshade (2), a plurality of LEDS (3) and a circuit board (4), characterized in that a bottom end of the lampshade (2) is mounted and fixed at a top end of the lamp cap (1); the circuit board (4) is mounted and fixed in the lampshade (2) and also electrically connected with the lamp cap (1); and the lampshade (2) is filled with a mixed gas which transfers heat produced by the LEDS (3) to outside of the bulb, wherein the mixed gas comprises nitrogen and argon, wherein the portion of nitrogen is 30%-90% of the total volume of the mixed gas and the portion of argon is 10%-70% of the total volume of the mixed gas.

2. The LED bulb according to claim 1, characterized in that the LEDS (3) are SMD LEDS.

3. The LED bulb according to claim 2, characterized in that the circuit board (4) consists of two printed circuit boards crisscrossed together, and the LEDS (3) are respectively welded and fixed on front sides and back sides of the printed circuit boards.

4. The LED bulb according to claim 3, characterized in that the circuit board (4) is provided with a rectification module (6), an input end of the rectification module (6) is connected with an AC input end of the lamp cap (1), and the LEDS (3) are connected between a positive output end and a negative output end of the rectification module (6) in series.

5. An LED bulb comprising: a lamp cap (1), a lampshade (2), a plurality of LEDS (3) and a circuit board (4), characterized in that a bottom end of the lampshade (2) is mounted and fixed at a top end of the lamp cap (1); the circuit board (4) is mounted and fixed in the lampshade (2) and also electrically connected with the lamp cap (1); and the lampshade (2) is filled with a mixed gas which transfers heat produced by the LEDS (3) to outside of the bulb, wherein the mixed gas is a mixed gas comprising nitrogen, argon, krypton and xenon.

6. The LED bulb according to claim 5, characterized in that the LEDS (3) are SMD LEDS.

7. The LED bulb according to claim 6, characterized in that the circuit board (4) consists of two printed circuit boards crisscrossed together, and the LEDS (3) are respectively welded and fixed on front sides and back sides of the printed circuit boards.

8. The LED bulb according to claim 7, characterized in that the circuit board (4) is provided with a rectification module (6), an input end of the rectification module (6) is connected with an AC input end of the lamp cap (1), and the LEDS (3) are connected between a positive output end and a negative output end of the rectification module (6) in series.

9. An LED bulb comprising: a lamp cap (1), a lampshade (2), a plurality of LEDS (3) and a circuit board (4), characterized in that a bottom end of the lampshade (2) is mounted and fixed at a top end of the lamp cap (1); the circuit board (4) is mounted and fixed in the lampshade (2) and also electrically connected with the lamp cap (1); and the lampshade (2) is filled with a mixed gas which transfers heat produced by the LEDS (3) to outside of the bulb, wherein the LEDS (3) are SMD LEDS and the circuit board (4) consists of two printed circuit boards crisscrossed together, and the LEDS (3) are respectively welded and fixed on front sides and back sides of the printed circuit boards.

10. The LED bulb according to claim 9, characterized in that the circuit board (4) is provided with a rectification module (6), an input end of the rectification module (6) is connected with an AC input end of the lamp cap (1), and the LEDS (3) are connected between a positive output end and a negative output end of the rectification module (6) in series.

11. The LED bulb of claim 9 wherein the mixed gas is one gas selected from nitrogen, argon, neon, krypton and xenon.

* * * * *